United States Patent [19]

Murray et al.

[11] 4,407,611

[45] Oct. 4, 1983

[54] ANCHORED EARTH STRUCTURE

[75] Inventors: Richard Murray, Three Mile Cross; Maurice J. Irwin, Camberley, both of England

[73] Assignee: The Secretary of State for Transport in Her Britannic Majesty's Government of the United Kingdom of Great Britain and Northern Ireland, London, England

[21] Appl. No.: 298,374

[22] Filed: Sep. 1, 1981

[30] Foreign Application Priority Data

Sep. 4, 1980 [GB] United Kingdom ..... 8028620

[51] Int. Cl.[3] ..... E02D 29/02; E02D 5/74

[52] U.S. Cl. ..... 405/284

[58] Field of Search ..... 405/284, 285, 286, 262

[56] References Cited

U.S. PATENT DOCUMENTS

| | | | |
|---|---|---|---|
| 3,229,468 | 1/1966 | Schneller | 405/285 X |
| 3,444,694 | 5/1969 | Frehner | 405/286 |
| 3,815,369 | 6/1974 | Meredith | 405/285 |
| 4,047,389 | 9/1977 | Yang | 405/286 X |
| 4,260,296 | 4/1981 | Hilfiker | 405/284 |
| 4,343,571 | 8/1982 | Price | 405/284 |

*Primary Examiner*—Nile C. Byers, Jr.

*Attorney, Agent, or Firm*—Stevens, Davis, Miller & Mosher

[57] ABSTRACT

An earth mass forming an embankment, bridge abutment or the like has a facing of light concrete panels from which steel rods project into the earth mass, the ends of the rods being bent in one direction and then the other (in the same plane) to form anchors which will oppose thrust on the facing but will permit deposition of earth fill in layers with each layer capable of being readily compacted without interference from the anchors. The rods extend through the panels in extended slots to accommodate earth settlement and are secured thereto by nuts. The facings are desirably lap jointed laterally and the anchors extend through adjacent overlapping portions.

10 Claims, 4 Drawing Figures

ANCHORED EARTH STRUCTURE

The present invention relates to anchored earth structures of the type in which stabilizing members are incorporated into the earth mass and impart tensile resistance. In contrast to known reinforced earth structures in which stabilizing members stabilize the earth by the operation of surface friction, anchored earth structures comprise a mass of material. such as natural earth in which stabilizing elements in the form of anchors are embedded. These anchors are attached to facing units which define at least a part of a structure. Such structures may, for example, be cuttings or embankments produced in connection with roadworks in which the facing units constitute retaining walls.

Stabilizing elements interact with the earth mass such that destabilizing forces on the mass place the stabilizing elements under tension and the resultant compressive reaction acts to stabilize the mass.

Anchored earth construction is advantageous in that soil can be contained by retaining walls of less massive construction than would be the case otherwise.

When forming an anchored earth structure it is usual to remove earth for some distance behind the location of a retaining wall and erect facing units progressively with their associated stabilizing elements while, at the same time, introducing and consolidating an earth fill behind the facing units and around the stabilizing elements until the desired structure is built up.

The compaction or consolidation of the earth fill in many cases gives rise to lateral pressures acting on the facing units and also to "locked-in" stresses between successive layers of the earth fill as this is built up.

The relief of these "locked in" stresses in anchored earth structures may be achieved by permitting a limited forward movement of the facing at an appropriate stage of construction by a slight relaxation of the attachment of the anchor to the facing. This enables the shear strength of the earth to be fully mobilized in the structure thereby minimizing the pressure on the facing and improving the factor of safety.

An object of the present invention is to realize the known advantages of anchored earth construction in an economical manner.

An anchored earth structure according to the present invention comprises an earth fill bounded by a plurality of facing units having overlapping portions, the overlapping portions being provided with co-operating vertically extending slots through which project the ends of anchors whose other ends constitute springs of serpentine form which are embedded in the earth fill.

Preferably the anchors are attached to the facing units by means of nuts on their projecting ends and serve also to connect adjacent facing units. The anchors are formed out of metal rods and are bent successively through gradually increasing angles and with portions following the bends of increasing length.

An embodiment of the present invention will now be described by way of example with reference to the accompanying drawings of which:

Figure 1:
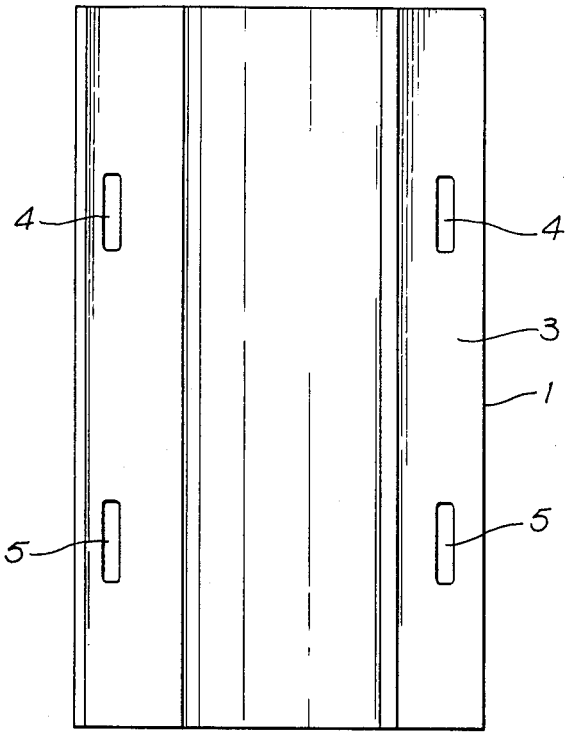
FIGS. 1 and 2 are respectively an elevation and plan of a facing unit.
Figure 2:
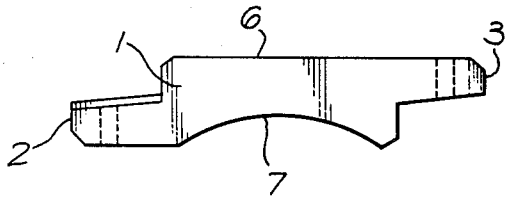

Referring to FIGS. 1 and 2, a facing unit 1, conventionally cast in reinforced concrete, is generally rectangular in elevation with one edge of each of its longer sides cut away, the respective cut-aways being on opposite faces to form projecting spurs 2, 3. When facing units are placed side-by-side (as in FIG. 4) the spur 2 of one will overlap the spur 3 of its neighbour. Two laterally-extending slots 4, 5 spaced along common axes pierce each of the spurs 2, 3. One face 6 of the facing unit 1 is flat and the opposite face 7 is concave.

Figure 3:
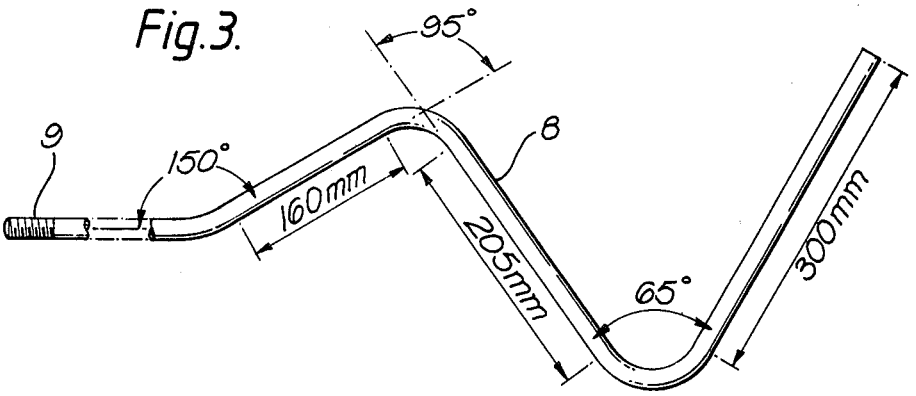
FIG. 3 is a plan view of an anchor member.

FIG. 3 shows a stabilizing element, or anchor, 8. This is formed from a mild steel bar of 15–20 mm diameter and has a screw threaded portion 9 at one end. Some 3–5 m from the threaded end, dependent on requirements, the bar is bent at a radius of 50 mm to an angle of 150°. Another bend is made after 160 mm, this time at 95° in the reverse sense to the first and in the same plane. A final blend in the reverse sense to the last is made after a further 205 mm, again in the same plane, after which the bar extends for 300 mm to its termination.

Figure 4:
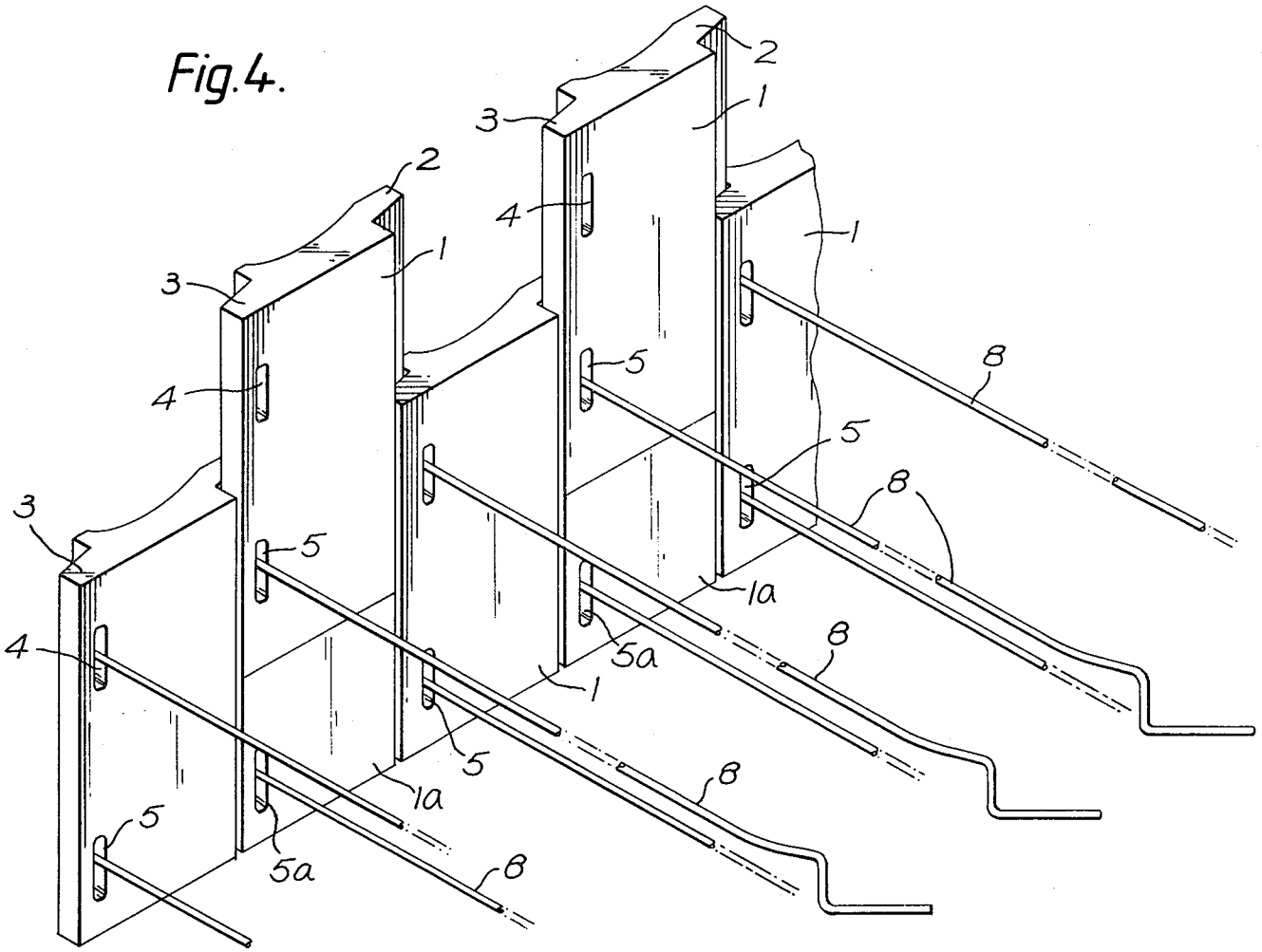
FIG. 4 is a general view of an assembly of facing units and anchor members.

An anchored earth structure is formed by erecting a series of adjacent facing units 1 with their respective spurs 2, 3 overlapping as shown in FIG. 4. Preferably the facing units are set on a strip footing of mass concrete to provide initial support and levelling. Alternate half height units 1*a* are interposed between normal height units to give a first course of castellated profile and which may be temporarily supported by props or other suitable means. A layer of earth fill is placed behind the flat faces of the facing units and compacted up to the level of the lower row of slots 5, 5*a*. Anchors 8 are laid flat (ie with their axial planes substantially horizontal) on the surface of the layer of fill and their respective screwthreaded ends are passed through the aligned slots in the overlapping spurs of the facing units, a nut then being attached. Normal height facing units are next placed on top of the half height ones, after which a further layer of earth fill is placed on the first and compacted up to the level of the second row of slots, the anchors 8 previously laid thus becoming embedded in the fill. More anchors 8 are laid on the new fill surface and the process repeated with additional facing units, layers of fill and anchors, until the desired structure height is obtained; half height facing units will again be utilised in the final course to give an even profile at the top of the facing.

It is desirable that the slots be closed off to prevent both the passage of water through them or the ingress of earth. This closure may be achieved by the use of foam rubber or polystyrene inserts, by shield-plates carried by the anchors, or other suitable means. It is also desirable to place compressible jointing between the facing units to prevent mutual damage, increase flexibility and reduce water leakage. Foam rubber, bitumen-impregnated tape or other treatment should preferably be applied on the surfaces of the half lap joints between facing units to provide an effective sealing medium.

By virtue of the slotted connections, relative movement can occur between adjacent units and also between the anchors and the facing to accommodate differential settlements without creating undue stress in the system. The nut on the end of each anchor is accessible from the front of the facing and any tendency for the facing units to get out of alignment can be corrected by judicious adjustment of the connections. Moreover, large pressures which are sometimes generated at the back of a facing as a result of construction operations and which remain locked in can be removed by a slight relaxation of the bolted connections. A further advantage of the connections being accessible relates to the potential for subsequent repair of the facing units or replcement of corroded anchors. It would be possible to assess the condition of individual anchors from time to time by carrying out load-extension tests and in the event that particular components were below the required standard as a result of corrosion, alternative or additional anchors could be installed through the slots.

Compared with stabilizing elements of flat strip configuration, the anchors permit a degree of yielding in the system at points where local overstress are induced as a result of differential settlement or uneven load distribution. This is achieved by virtue of the serpentine free end of the anchor expanding as a spring and the retaining structure as a whole can be considered to be of a flexible nature. The particular shape utilized involves very simple fabrication, has demonstrated high resistance in both laboratory and full-scale tests and is considered to be an optimum design in terms of economy and efficiency. Moreover, the circular cross-section minimizes the surface area in contact with the soil and reduces the corrosion hazard and is also less susceptible to the effects of pitting corrosion attack than would be the case for flat strip types of component as employed in reinforced earth systems, while connection problems arising out of the elimination of the need for forming holes or swaged ends and the attendant reduction in cross-sectional area is considerably reduced.

Ideally the anchors should pass through the slots in the facing units at about mid-height to permit any mode of deformation to be accommodated. However, if it was anticipated that the movements would occur mainly within the fill, the anchors could be positioned towards the top of the slot to allow a greater magnitude of relative settlement between the anchored soil and facing to take place.

A wide range of soils from rock fill to heavy clay can be accommodated in the backfill region. Corrosive soils could still create a hazard but various protective coatings are available to protect the anchors. The resistance of the anchors is not sensitive to surface characteristics, particularly over the length of bar between the connection and the start of the anchor bend and even bituminous paints could therefore be employed over this region.

Since the anchors are not significantly dependent on friction, they are more efficient in cohesive soils and vertical projections, as proposed for flat strips to give increased holding power, are generally unnecessary and thus the risk of damage during compacting operations can be eliminated while the filling process itself is uncomplicated.

The anchors can also be shorter than equivalent flat strip stabilizing elements, an advantage where space is restricted and might permit tapering off of compacting towards the top of a structure.

We claim:

1. An anchored earth structure comprising:

an earth fill;

a plurality of facing units bounding the earth fill, said facing units having overlapping flanges with vertically extending slots therein, the slots of an overlapping flange of one facing unit being arranged so as to be in substantial alignment with the slots of an overlapping flange of an adjoining facing unit;

a plurality of anchors embedded in said earth fill and attached to respective facing units of said plurality of facing units, each of said anchors having an anchoring portion at one end thereof and an attachment portion at an opposite end thereof, said anchoring portion having a substantially serpentine form, said anchoring portion being further characterized by a spring-like resiliency, the attachment portion of said anchors extending through said slots; and means for attaching said attachment portions of said anchors to respective facing units of said plurality of facing units.

2. An anchored earth structure according to claim 1, wherein the attachment portion of said anchors comprises screw-threaded rods and the means for attaching said attachment portions comprises complementary screw-threaded nuts.

3. An anchored earth structure according to claim 1, wherein said anchors comprise metal rods, the anchor portions of which have successively larger bends as the bends become more remote from the attachment portions.

4. An anchored earth structure according to claim 1, wherein the bends on each anchor lie in the same plane.

5. An anchored earth structure according to claim 1, wherein the portions of each other anchor portion between successive bends are of differing lengths.

6. An anchored earth structure according to claim 5, wherein the portions between the bends increase in length as they become more remote from the attachment portion of said anchors.

7. An anchored earth structure comprising:

an earth fill;

an array of facing plates bounding the earth fill, each facing plate having a flange on vertical sides thereof interfitting with a similar flange on an adjacent plate and vertical slots in said flanges which align as between contiguous flanges;

a plurality of anchors embedded substantially horizontally in said earth fill, each of said anchors comprising a rod which is screw threaded at an attachment end thereof, said attachment end passing through the slots and receiving an attachment nut, and which in an anchor portion thereof has planar serpentine form which increasing angles between increasing lengths of the rod the more remote said anchor is from said attachment end.

8. An apparatus for forming an anchored earth structure comprising:

a plurality of facing units, said facing units having overlapping flanges with vertically extending slots therein, the slots of an overlapping flange of one facing unit being arranged so as to be capable of substantial alignment with the slots of an overlapping flange of an adjoining facing unit;

a plurality of anchors capable of substantially horizontally extending attachment to respective facing units of said plurality of facing units, each of said anchors having an anchoring portion at one end thereof and an attachment portion at an opposite end thereof, said anchoring portion having a substantially serpentine form, said anchoring portion being further characterized by a spring-like resiliency, the attachment portion of said anchors extending through said slots thereby allowing attachment of the anchors to said facing units; and means for attaching said attachment portion of said anchors to respective facing units of said plurality of facing units.

9. A method of forming an anchored earth structure comprising the steps of:

forming a strip footing;

emplacing on the footing a first layer of facing units, said facing units having mutually cooperating flanges along the vertical edges thereof, and vertically extending slots in said flanges which align one with another as between adjacent facing units;

consolidating a layer of earth fill behind said facing units up to the level of the lowest of the slots;

laying on said layer of earth fill a plurality of anchors with attachment ends of said anchors protruding through the slots in said facing units, said anchors having anchor portions of planar serpentine form;

consolidating on said layer of earth fill and anchors further layers of earth fill and anchors, and emplacing further layers of facing units on said first layer of facing units; and attaching said anchors to said facing units.

10. A method of forming an anchored earth structure as claimed in claim 9, wherein said first layer of facing units comprises alternating facing units of full and half-size length.

* * * * *